US007555232B2

(12) United States Patent
Imura

(10) Patent No.: US 7,555,232 B2
(45) Date of Patent: Jun. 30, 2009

(54) IMAGE FORMING APPARATUS AND DEVELOPING METHOD

(75) Inventor: Tomoyuki Imura, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 244 days.

(21) Appl. No.: 11/163,550

(22) Filed: Oct. 22, 2005

(65) Prior Publication Data

US 2006/0239702 A1 Oct. 26, 2006

(30) Foreign Application Priority Data

Apr. 22, 2005 (JP) ..... 2005-125564

(51) Int. Cl.
*G03G 15/06* (2006.01)
*G03G 15/00* (2006.01)
*G03G 21/20* (2006.01)

(52) U.S. Cl. ..... 399/55; 399/44; 399/97

(58) Field of Classification Search ..... 399/44, 399/55, 97, 235, 240
See application file for complete search history.

(56) References Cited

U.S. PATENT DOCUMENTS 7,092,662 B2 * 8/2006 Yamamura ..... 399/285
2005/0158061 A1 * 7/2005 Do ..... 399/44

FOREIGN PATENT DOCUMENTS

| | | |
|---|---|---|
| JP | 2001-109243 | 4/2001 |
| JP | 2001-265110 | 9/2001 |
| JP | 2002-148894 | 5/2002 |
| JP | 2003-057945 | 2/2003 |
| JP | 2004-163502 | 6/2004 |

OTHER PUBLICATIONS

Japanese Decision to Grant Patent for Application No. 2005-125564, dated Feb. 26, 2008 and its English translation.

* cited by examiner

*Primary Examiner*—David M Gray
*Assistant Examiner*—Joseph S Wong
(74) *Attorney, Agent, or Firm*—Buchanan Ingersoll & Rooney PC

(57) ABSTRACT

An image forming apparatus has a plurality of developing devices each including a developing member carrying and transferring developer toward a developing region and a charging member charging developer carried by the developing member, a development bias applying device applying an AC development bias voltage to the developing member, and a charge bias applying device applying to the charging member an AC charge bias voltage having a phase synchronized with the AC development bias voltage and representing a charge bias voltage value causing an offset potential difference with respect to the AC development bias voltage in a phase on one of positive and negative sides. The charge bias voltage applied by the charge bias applying device provided for each of the developing devices has the same voltage value as the charge bias voltages applied by the charge bias applying devices of the other charge bias applying devices.

11 Claims, 6 Drawing Sheets

IMAGE FORMING APPARATUS AND DEVELOPING METHOD

CROSS-REFERENCE TO RELATED APPLICATION

This application is based on Japanese patent application No. 2005-125564 filed in Japan on Apr. 22, 2005, the entire content of which is hereby incorporated by reference.

BACKGROUND OF THE INVENTION

1. Field of the Invention

The present invention relates to an image forming apparatus such as a color copying machine or a color printer having a plurality of developing devices, each of which can develop an electrostatic latent image formed on an image carrying member corresponding to the developing device with developer of a color assigned to the developing device.

The present invention also relates to a developing method in an image forming apparatus having a plurality of developing devices.

2. Description of Related Art

Nowadays, image forming apparatuses such as copying machines and printers, which form images by developing electrostatic latent images formed on image carrying member with developer, are widely available, and color image forming apparatuses are rapidly spreading. In this situation, awareness of users about the image quality and image formation cost keep on rising.

In connection with the image quality, it is desired to eliminate or minimize image noises in the images. So-called "fogging" is a kind of such image noises. The "fogging" phenomenon is primarily caused by lowering of a charge amount of the developer used for image formation, and this lowering is caused by deterioration of the developer.

The lowering of the developer charge amount due to the deterioration of the developer causes the above fogging, and further increases a developer consumption due to occurrence of the fogging so that a cost to the user increases.

The developing devices developing the electrostatic latent images on the image carrying member can be roughly divided according to the type of the developer used therein into two types, i.e., a two-component developing device using a so-called two-component developer primarily formed of toner and carrier, and a one-component developing device using a so-called one-component developer which is primarily formed of toner and does not contain carrier.

In either of the above types, the developing device generally employs a developing roller, which carries the developer on its peripheral surface, and transfers it to a developing region. When developing the electrostatic latent image, a development bias voltage is generally applied to the developing roller for smoothly moving the developer on the developing roller to the electrostatic latent image. For obtaining an image of high quality by suppressing unremovable adhesion of the developer onto the developing roller, the development bias voltage is often formed of an AC development bias voltage employing a combination of DC and AC voltages (typically, a DC voltage and an AC voltage superimposed thereon).

In the developing device (one-component developing device) using the developer primarily formed of the toner, a charging member is generally in contact with the developer, which is carried on the developing roller and is being transferred to the developing region, and frictionally charges the developer for obtaining a charge amount of the developer required for development of the electrostatic latent image.

The charging member generally serves also as a developer restricting member for restricting the amount of developer transferred to the developing region to provide a thin layer thereof.

However, if the charging is performed only by the frictional charging, a failure occurs in developer charging when the developer deteriorates due to repeating of the image formation. Therefore, such a manner is also employed that the developer is electrically charged by setting a potential difference between a developer charging member also serving as the above restricting member and the developing roller, or by setting a potential difference between a developer charging member, which is independent of the developer charging member also serving as the restricting member, and the developing roller.

It is preferable to produce the potential difference between the developer charging member and the developing roller by applying an AC charge bias voltage for suppressing unremovable or strong adhesion of the developer onto the developing roller or the developer charging member.

In connection with this, Japanese Laid-Open Patent Publication No. 2001-109243 (JP 2001-109243 A) has disclosed:

(1) a developing device which employs an AC development bias voltage formed of a DC voltage and an AC voltage superimposed thereon as a development bias voltage to be applied to the developing roller, and particularly, a developing device which applies an AC charge bias formed of another DC voltage and an AC voltage superimposed thereon to the developer charging member for producing a potential difference between the developer charging member also serving as the restricting member and the developing roller, and (2) a developing device generating an AC charge bias voltage, of which phase on only one side (i.e., positive or negative side) is offset (i.e., of which amplitude is reduced) by using a Zener diode, and applying it to the developer charging member for obtaining the AC charge bias voltage applied to the developer charging member at a low cost.

FIG. 10(A) shows an example of a bias voltage applying circuit in the latter developing device.

According to the circuit shown in FIG. 10(A), a power source formed of a DC power source Vdc and a rectangular-wave AC power source Vac, which are connected in series, are employed as an AC development bias power source pw, and a Zener diode td" and a resistance element r" are connected in series to an output terminal a" of the power source pw. A developing roller is connected to the output end a", and a charging member is connected to a contact b" between the Zener diode td" and the resistance element r".

This circuit is an example of a circuit for image formation in which a negatively chargeable photosensitive member is employed as an image carrying member for forming an electrostatic latent image thereon, and reversal development of the electrostatic latent image on the photosensitive member is performed with negatively chargeable toner.

In this circuit, it is assumed that the DC power source Vdc of the development bias power source pw provides an output voltage of −400 V, a peak-to-peak voltage of the AC power source Vac is 1800 V and a breakdown voltage of the Zener diode td" is 200 V. In this case, the developing roller is supplied with the AC development bias voltage having a waveform represented by solid line in FIG. 10(B). The charging member is supplied, as represented by broken line in FIG. 10(B), with an AC charge bias voltage which has a phase synchronized with the AC development bias voltage applied to the developing roller, and exhibits an offset potential difference of 200 V in the phase on the positive side. In the phase on the negative side, the substantially same potentials are applied to the developing roller and the charging member.

This circuit structure utilizes the AC power source Vac in the AC development bias power source pw, and thereby can provide the AC charge bias voltage at a low cost. The AC charge bias in the phase on the positive side is offset with respect to the development bias (i.e., the offset potential difference is set) so that it is attempted to optimize the toner charge amount.

In any one of the conventional developing devices already described, it is possible to increase the charge level of the deteriorated developer, and thereby to reduce the reversely chargeable developer, i.e., the developer which is charged reversely to the regularly chargeable developer, and therefore becomes a primary cause of the fogging phenomenon. Therefore, the image quality can be improved.

According to the study by the inventors, a developing device configured to set a potential difference between a developer charging member and a developing roller causes such a situation that initial developer, which has a charging property at an appropriate level and is usually in a low-humidity environment, is excessively charged.

The developing roller strongly restrains the excessively charged developer by a Coulomb force, and suppresses smooth movement thereof toward an electrostatic latent image on an image carrying member so that desired development cannot be performed. Further, excessively charged components may cause fogging.

For overcoming the above problem, the potential difference between the charging member and the developing roller may be reduced. Although such setting can overcome the above problem relating to the initial developer, it is difficult to prevent the occurrence of fogging due to the deteriorated developer by such setting.

In an image forming apparatus such as a color copying machine or a color printer, which employs a plurality of developing devices corresponding to respective colors of developer, each developing device may have a circuit structure which applies to a developer charging member a charge bias voltage having a phase synchronized with an AC development bias voltage and exhibiting an offset potential difference with respect to this AC development bias voltage. However, each of the developing devices independently suffers from a problem similar to that already described. Thus, variations in factors determining the charging property of the developer cannot be dealt with, and a failure occurs in developer charge amount.

In an image forming apparatus with a plurality of developing devices, a developer charging member may be supplied with an AC charge bias voltage, which is formed of a DC voltage and an AC voltage superimposed thereon, and is independent of an AC development bias voltage applied to a developing roller, as disclosed in Japanese Laid-Open Patent Publication No. 2001-109243.

According to this configuration, the amplitude of the AC development bias voltage can be increased independently of the AC charge bias voltage so that the movability of the developer from the developing roller to an electrostatic latent image carrying member can be improved, and in other words, the developing property can be improved. However, the charge bias is fixed with respect to the development bias, and therefore it is impossible to optimize the developer charge amount in accordance with variation in a factor determining the chargeability of the developer.

Further, each developing device requires two AC power sources, i.e., an AC power source for the AC development bias voltage and an AC power source for the AC charge bias voltage. Since the AC power sources are expensive, the image forming apparatus becomes expensive.

The inventor has made study to found the following.

The circuit structure shown in FIG. 10(A) already described was employed to apply an AC charge bias voltage to the charging member while selectively using various Zener diodes having different breakdown voltages, and thereby changing the offset potential difference to various values, respectively. Thereby, the following was found in connection with the case where initial toner (i.e., unused toner) is used in a low humidity environment, and thus charging is relatively easy, and in connection with the case where the toner (used toner) is used in a high humidity environment, and thus charging is relatively difficult.

As illustrated in FIG. 9, (1) the offset potential difference governs the toner charge amount in both the cases, and (2) there is a tendency that the charge amount of the initial toner is larger than that of the user toner. For example, if the appropriate charge amount of the toner is in a range from −20 μC/g to −40 μC/g, the offset potential difference, which can achieve the charge amount of the used toner within a range from −20 μC/g to −40 μC/g, achieves the toner charge amount of the initial toner exceeding −40 μC/g. Further, it was found that the appropriate developer charge amount is obtained by controlling the offset potential difference according to a factor affecting the charging property of the developer.

SUMMARY OF THE INVENTION

Accordingly, an object of the invention is to provide an image forming apparatus having a plurality of developing devices each capable of developing an electrostatic latent image formed on an image carrying member, and particularly an image forming apparatus configured such that each developing device can charge developer to attain an appropriate charge amount for developing the electrostatic latent image, thereby can develop the electrostatic latent image with good developing property while suppressing occurrence of fogging, and can form an image of high quality at a low cost.

Based on the above finding and further study, the invention provides the following image forming apparatus and developing method in an image forming apparatus.

(1) Image Forming Apparatus

An image forming apparatus comprising an image carrying member, a plurality of developing devices each capable of developing an electrostatic latent image formed on said image carrying member, a development bias applying device provided for each of said plurality of developing devices, a charge bias applying device provided for each of said plurality of developing devices and a control unit controlling said charge bias applying device provided for each of said plurality of developing devices, wherein each of said plurality of developing devices includes a developer carrying member carrying and transferring developer to a developing region developing said electrostatic latent image formed on said image carrying member, and a charging member being in contact with the developer carried on said developer carrying member and charging the developer;

said development bias applying device applies an AC development bias voltage including an AC voltage to said developer carrying member;

said charge bias applying device applies to said charging member an AC charge bias voltage having a phase synchronized with said AC development bias voltage and representing a charge bias voltage value causing an offset potential difference with respect to said AC development bias voltage in a phase on at least one of positive and negative sides;

said charge bias voltage applied by the charge bias applying device provided for each of said plurality of developing devices and causing said offset potential difference has the same voltage value as the charge bias voltages applied by the charge bias applying devices of the other charge bias applying devices; and said control unit controls said charge bias applying device provided for each of said plurality of developing devices according to at least one of factors affecting a charging property of the developer transferred to said developing region, and thereby controls said same charge bias voltage value to provide said offset potential difference causing the developer to bear a regular charge amount for developing the electrostatic latent image.

(2) Developing Method

A developing method in an image forming apparatus including a plurality of developing devices comprising the steps of:

transferring developer by a developer carrying member to a developing region developing an electrostatic latent image formed on an image carrying member;

applying an AC development bias voltage to said developer carrying member;

applying an AC charge bias voltage to a charging member being in contact with the developer carried on said developer carrying member, said AC charge bias voltage having a phase synchronized with said AC development bias voltage and representing a charge bias voltage value causing an offset potential difference with respect to said AC development bias voltage in a phase on at least one of positive and negative sides and common to said developing devices;

controlling said common charge bias voltage value according to at least one of factors affecting a charging property of the developer;

developing the electrostatic latent image on said image carrying member by the developer at said developing region.

The invention can be utilized in the image forming apparatus having the plurality of developing devices for optimizing the developer charge amount and ensuring the developing property in each developing device so that images of high quality can be formed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
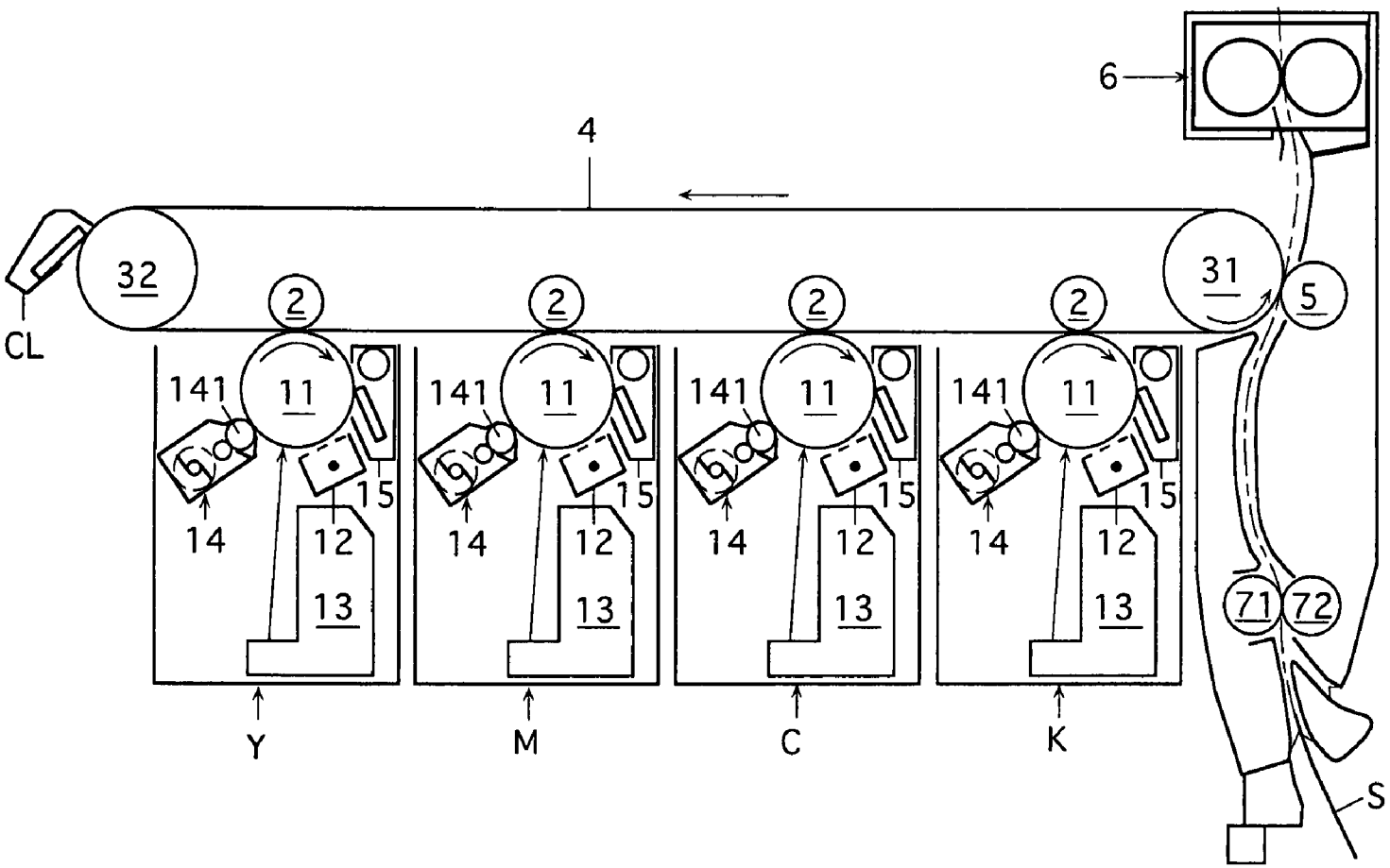
FIG. 1 schematically shows a structure of an example of an image forming apparatus according to the invention.

Basically, an image forming apparatus of an embodiment of the invention has a plurality of developing devices each capable of developing an electrostatic latent image formed on an image carrying member, a development bias applying device provided for each of the plurality of developing devices, a charge bias applying device provided for each of the plurality of developing devices and a control unit controlling the charge bias applying device provided for each of the plurality of developing devices.

Each of the developing devices includes a developer carrying member carrying and transferring developer to a developing region developing the electrostatic latent image on the image carrying member, and a charging member being in contact with the developer carried on the developer carrying member and charging the developer.

The development bias applying device applies an AC development bias voltage including an AC voltage to the developer carrying member.

The charge bias applying device applies to the charging member an AC charge bias voltage having a phase synchronized with the AC development bias voltage and representing a charge bias voltage causing an offset potential difference with respect to the AC development bias voltage in a phase on at least one of positive and negative sides.

The charge bias voltage applied by the charge bias applying device provided for each of the plurality of developing devices and causing the offset potential difference has the same voltage value in the phase on only one of the positive and negative sides as the charge bias voltages applied by the charge bias applying devices of the other charge bias applying devices.

The control unit controls the charge bias applying device according to at least one of factors affecting a charging property of the developer transferred to the developing region, and thereby controls the same charge bias voltage value to provide the offset potential difference causing the developer to bear a regular charge amount for developing the electrostatic latent image.

According to this image forming apparatus, the amplitude of the AC development bias voltage applied to the developer carrying member in each developing device is set according to characteristics and others of the toner used in the same developing device such that the developer may move smoothly from the developer carrying member to the electrostatic latent image, i.e., such that good developing property may be achieved.

Under the above conditions, the AC charge bias voltages in the respective developing devices represent the same charge bias voltage value in the phase on one side. Therefore, in the developing device of which AC development bias voltage has a large amplitude, the same charge bias voltage value causes a large offset potential difference with respect to the AC development bias voltage, and thereby absolute value of the charge amount of the developer charged by the charging member increases. However, the amplitude of the AC development bias voltage covers a loss in developing property.

The control unit controls the charge bias applying device according to at least one of the factors affecting the charging property of the developer transferred to the developing region, and thereby can control the same charge bias voltage value so that the offset potential difference based on the same charge bias voltage value can be set to charge the developer to have the regular charge amount for developing the electrostatic latent image.

Thereby, each developing device can ensure the good developing property and the appropriate developer charge amount, and thereby can form images of good quality.

The charge bias applying device of each developing device applies the AC charge bias voltage having a phase synchronized with that of the AC development bias voltage to the charging member. Therefore, the development bias applying device generating the AC development bias voltage can be utilized as the AC power source so that each developing device can be inexpensive, and thus the image forming apparatus can be inexpensive.

In the above image forming apparatus, the "regular charge amount" of the developer is an appropriate charge amount, but is not required to be a fixed value. For example, the "regular charge amount" may fall within a range from −20 μC/g to −40 μC/g.

Each developing device in the image forming apparatus may include a restricting member restricting the developer carried on the developer carrying member and transferred to the developing region to form a thin layer while frictionally charging the developer. Alternatively, the charging member may also serve as the restricting member.

The AC development bias voltage and the AC charge bias voltage may have various waveforms which can achieve the object of the invention, and may have, e.g., rectangular waveforms, respectively. Thus, each of the AC development bias voltage and the AC charge bias voltage may be a rectangular-wave voltage.

The "factor affecting the charging property of the developer transferred to the developing region" may be typically environmental conditions.

The "environmental conditions" may be typically an ambient temperature and/or an ambient humidity of the developing device, and particularly may be the ambient humidity.

When the ambient environment of the developing device is a low-humidity environment, charging of the developer is relatively promoted. When it is a high-humidity environment, charging of the developer is relatively suppressed.

Accordingly, the control unit may be configured, for example, to control the charge bias applying device according to the environment conditions, and thereby control the foregoing same charge bias voltage value for controlling the offset potential difference.

The development bias applying device may include a development bias power source applying the AC development bias voltage to the developer carrying member.

The charge bias applying device may include a resistance element, a diode and an output-variable charge DC power source (i.e., output-variable DC power source for charging), which are connected in series to an output terminal of the development bias power source in this order.

When the above charge bias applying device is employed, the charging member may be connected between the resistance element and the diode. The control unit may be configured to control the output voltage of the output-variable charge DC power source, and thereby to control the same charge bias voltage value to provide the offset potential difference causing the developer to bear the regular charge amount for developing the electrostatic latent image.

In any one of the above cases, the charge bias applying device utilizes the development bias power source, and can be inexpensive.

The output-variable charge DC power source may be one in number, and can be shared by the charge bias applying devices provided for the plurality of developing devices. This can further reduce a cost of the image forming apparatus.

In the structure having the one output-variable charge DC power source for the plurality of developing devices, the control unit may be configured to control the output voltage of the one charge DC power source, and thereby to control the same charge bias voltage value to provide the offset potential difference causing the developer to bear the regular charge amount for developing the electrostatic latent image.

In the case where the development bias applying device and the charge bias applying device are employed, a Zener diode and a second resistance element may be connected in series to the output terminal of the development bias power source in this order, and the developer carrying member may be connected between the Zener diode and the second resistance element.

An example of an image forming apparatus according to the invention will now be described with reference to drawings.

An image forming apparatus in FIG. 1 is a full-color image forming apparatus of a so-called tandem type.

This image forming apparatus has an endless transfer belt 4 passing around a drive roller 31 and a driven roller 32 opposed thereto. The drive roller 31, which is driven to rotate by a drive unit (not shown), drives and rotates the transfer belt 4 counterclockwise (in a direction of an arrow) in FIG. 1. The counter roller 32 is opposed to a cleaner CL cleaning secondary-transfer residual toner and others on the transfer belt 4, and a secondary transfer roller 5 is opposed to the drive roller 31. A fixing device 6 is arranged above the secondary transfer roller 5.

Yellow, magenta, cyan and black image forming units Y, M, C and K are arranged along the transfer belt 4 and between the rollers 31 and 32, and the yellow image forming unit Y neighbors to the roller 32.

Each image forming unit includes a photosensitive member 11 of a drum type as an electrostatic latent image carrying member, and a charging device 12, an image exposing device 13, a developing device 14, a primary transfer roller 2 and a cleaner 15 removing primary-transfer residual toner and others on the photosensitive member 11 are arranged in this order around the photosensitive member 11. The primary transfer roller 2 is opposed to the photosensitive member 11 with the transfer belt 4 therebetween.

In this embodiment, the photosensitive member 11 in each image forming unit is negatively chargeable, and the developing device 14 uses negatively chargeable toner, and performs reversal development of the electrostatic latent image formed on the photosensitive member 11.

This image forming apparatus forms an image as follows.

First, at least one of the image forming units Y, M, C and K forms an image(s) according to an image to be formed finally.

For example, when a full-color image is to be formed by using all the image forming units Y, M, C and K, the yellow image forming unit first forms a yellow toner image, and transfers it onto the transfer belt 4 by the primary transfer roller 2.

More specifically, in the yellow image forming unit Y, the photosensitive member 11 is rotated clockwise in FIG. 1, and the charging device 12 uniformly charges the surface of the photosensitive member 11 to bear a predetermined potential. The image exposing device 13 effects the image exposure for the yellow image on the charged region so that an electrostatic latent image for yellow is formed on the photosensitive member 11. This electrostatic latent image is developed into a visible yellow toner image by a developing roller 141, to which a development bias is applied, of the developing device 14 having yellow toner. The primary transfer roller 2 transfers this toner image onto the transfer belt 4.

Likewise, the magenta image forming unit M forms a magenta toner image, and transfers it onto the transfer belt 4. The cyan image forming unit C forms a cyan toner image, and transfers it onto the transfer belt 4. The black image forming unit K forms a black toner image, and transfers it onto the transfer belt 4.

The yellow, magenta, cyan and black toner images are formed at such timings that they are transferred onto the intermediate transfer belt 4 in a superimposed fashion.

The multiple toner images formed on the transfer belt 4 in this manner are moved toward the secondary transfer roller 5 by the rotating transfer belt 4.

A recording medium (record paper sheet or the like) S is pulled out from a recording medium supply unit (not shown), and is supplied by a timing roller pair 71 and 72 to a position between the transfer belt 4 and the secondary transfer roller 5 in synchronization with the multiple toner images on the belt 4. Then, the secondary transfer roller 5 performs the secondary transfer of the multiple toner images onto the recording medium S. Thereafter, the recording medium S is supplied into the fixing device 6, in which the multiple toner images are fixed onto the recording medium S by the heat and pressure so that a predetermined color image is formed on the recording medium S. Thereafter, the recording medium S is discharged from the apparatus.

In each image forming unit, the cleaner 15 cleans and removes primary-transfer residual toner and others remaining on the photosensitive member 11 after the primary transfer. After the secondary transfer, the cleaner CL cleans and collects the secondary-transfer residual toner and others remaining on the transfer belt 4 after the secondary transfer.

Each developing device 14 will now be described in greater detail.

Figure 2:
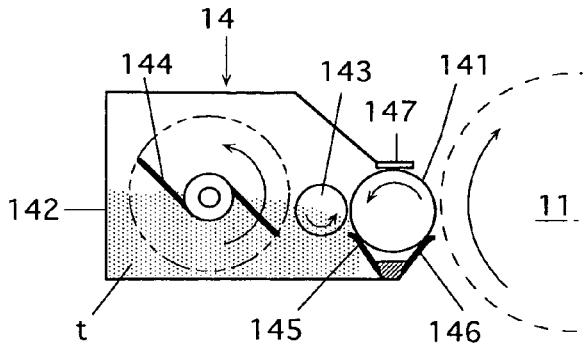
FIG. 2 shows a structure of a developing device in the image forming apparatus shown in FIG. 1.

FIG. 2 shows a structure of each developing device. As shown in FIG. 2, the developing device 14 includes the developing roller 141. The developing roller 141 is rotatably carried by a developing device casing 142, and has a portion which protrudes outward from the casing 142, and is opposed to the photosensitive member 11 with a minute space therebetween. In the casing 142, a developer supply roller 143 is opposed to the developing roller 141, and a developer stirring member 144 is arranged behind the developer supply roller 143. The developer supply roller 143 and the developer stirring member 144 are both carried rotatably by the casing 142.

A blade-like developer restricting member 145 and a blade-like charging member 146 are arranged in the casing 142. The developer restricting member 145 is carried by the casing 142 in a cantilever fashion, and is pressed against the developing roller 141. The charging member 146 is carried by the casing 142 in a cantilever fashion, and is pressed more weakly than the restricting member 145 against the developing roller 141.

A seal member 147 is arranged between the upper portion of the developing roller 141 and the casing 142 for preventing leakage of the developer. The developer restricting member 145 prevents the leakage of the developer between the lower portion of the developing roller 141 and the casing 142.

Figure 3:
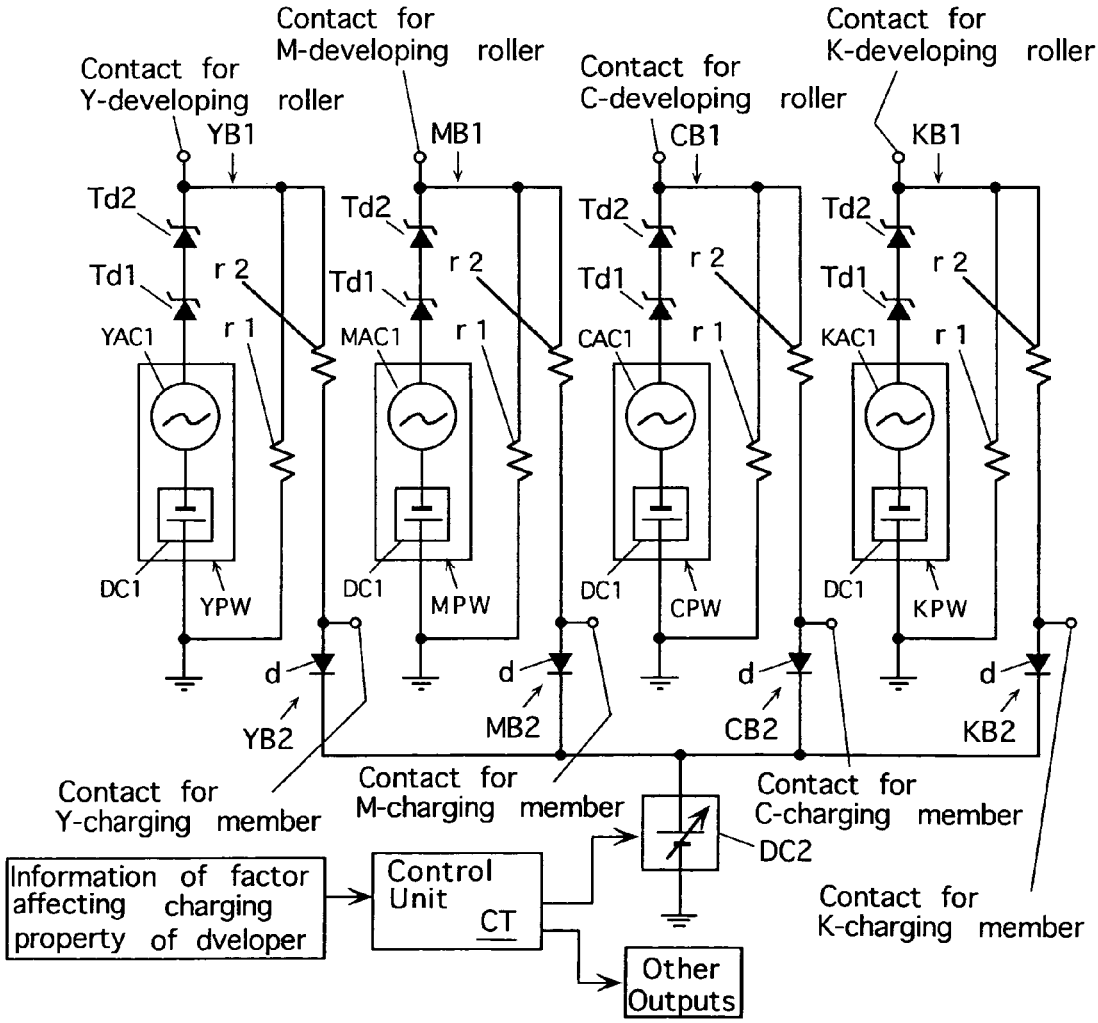
FIG. 3 shows an example of a bias applying circuit related to the plurality of developing devices.

FIG. 3 illustrates a circuit applying biases to each developing device 14 in the image forming apparatus shown in FIG. 1. In FIG. 3, the developing roller 141 of the yellow developing device 14 in the yellow image forming unit Y is expressed as "Y-developing roller", and the charging member 146 thereof is expressed as "Y-charging member".

Likewise, the developing roller of the magenta developing device 14 in the magenta image forming unit M is expressed as "M-developing roller", and the charging member thereof is expressed as "M-charging member".

The developing roller of the cyan developing device 14 in the cyan image forming unit C is expressed as "C-developing roller", and the charging member thereof is expressed as "C-charging member".

The developing roller of the black developing device 14 in the black image forming unit K is expressed as "K-developing roller", and the charging member thereof is expressed as "K-charging member".

The Y-developing roller is connected to a development bias applying device YB1, and the Y-charging member is connected to a charge bias applying device YB2. Likewise, the M-developing roller is connected to a development bias applying device MB1, and the M-charging member is connected to a charge bias applying device MB2. The C-developing roller is connected to a development bias applying device CB1, and the C-charging member is connected to a charge bias applying device CB2. The K-developing roller is connected to a development bias applying device KB1, and the K-charging member is connected to a charge bias applying device KB2.

In the yellow developing device 14 of the yellow image forming unit Y, the development bias applying device YB1 is formed of a development bias power source YPW, which is formed of a negative DC power source DC1 and a rectangular-wave AC power source YAC1 connected together in series, two Zener diodes Td1 and Td2, and a resistance element r1 connected in series in this order. The Y-developing roller is connected between the Zener diode Td2 and the resistance element r1.

The charge bias applying device YB2 is formed of a resistance element r2, a diode d and an output-variable positive DC power source DC2 for charging, which are connected in series to a Y-developing roller contact in this order, and the Y-charging member is connected between the resistance element r2 and the diode d.

Likewise, in the magenta developing device of the magenta image forming unit M, the development bias applying device MB1 is formed of a development bias power source MPW, which is formed of a negative DC power source DC1 and a rectangular-wave AC power source MAC1 connected together in series, two Zener diodes Td1 and Td2, and a resistance element r1 connected in series in this order. The M-developing roller is connected between the Zener diode Td2 and the resistance element r1.

The charge bias applying device MB2 is formed of a resistance element r2, a diode d and the foregoing DC power source DC2, which are connected in series to a M-developing roller contact in this order, and the M-charging member is connected between the resistance element r2 and the diode d.

Likewise, in the cyan developing device of the cyan image forming unit C, the development bias applying device CB1 is formed of a development bias power source CPW, which is formed of a DC power source DC1 and a rectangular-wave AC power source CAC1 connected together in series, two Zener diodes Td1 and Td2, and a resistance element r1 connected in series in this order. The C-developing roller is connected between the Zener diode Td2 and the resistance element r1.

The charge bias applying device CB2 is formed of a resistance element r2, a diode d and the foregoing DC power source DC2, which are connected in series to a C-developing roller contact in this order, and the C-charging member is connected between the resistance element r2 and the diode d.

In the black developing device of the black image forming unit K, the development bias applying device KB1 is formed of a development bias power source KPW, which is formed of a DC power source DC1 and a rectangular-wave AC power source CAC1 connected together in series, two Zener diodes Td1 and Td2, and a resistance element r1 connected in series in this order. The K-developing roller is connected between the Zener diode Td2 and the resistance element r1.

The charge bias applying device KB2 is formed of a resistance element r2, a diode d and the forgoing DC power source DC2, which are connected in series to a K-developing roller contact in this order, and the K-charging member is connected between the resistance element r2 and the diode d.

The Zener diodes Td1 and Td2 in each development bias applying device are provided for the purpose of offsetting and stabilizing the AC developing bias voltage in the phase on the negative side.

As will be described later with reference to FIG. 4, the maximum value of the AC development bias in the phase on the negative side may be set by the output of the development bias power source YPW. In this case, the Zener diodes Td1 and Td2 may be eliminated.

The DC power source DC2 is shared by the charge bias applying devices of all the developing devices, and a control unit CT controls the output voltage of the power source DC2 as will be described later.

Figure 4:
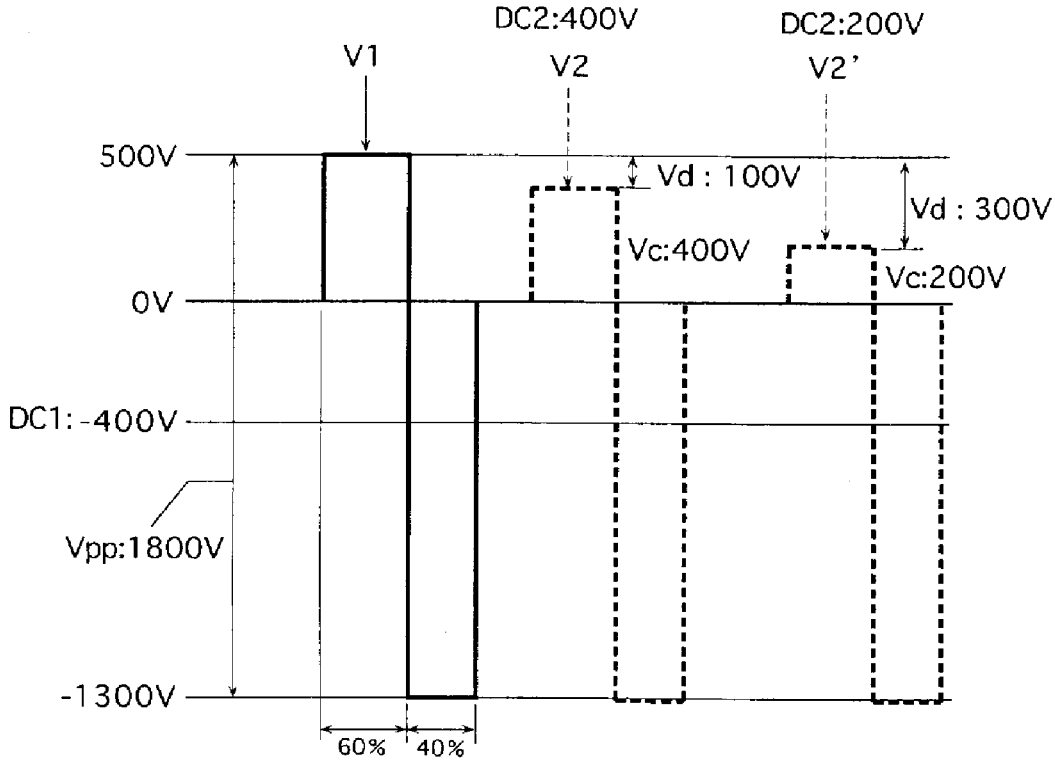
FIG. 4 illustrates, by way of example, waveforms of an AC development bias voltage and an AC charge bias voltage in one developing device together with offset potential differences and others.

For example, when the yellow developing device develops the electrostatic latent image on the photosensitive member 11, the development bias applying device YB1 applies an AC development bias voltage V1 of a rectangular waveform, which is illustrated by solid line in FIG. 4, to the developing roller 141, and causes the toner t on the developing roller to jump onto the electrostatic latent image on the photosensitive member 11. The developing roller 141 may be arranged in contact with the photosensitive member 11 depending on the development bias and others.

For developing the electrostatic latent image on the photosensitive member 11, the charge bias applying device YB2 provides an AC charge bias voltage V2 or V2', e.g., illustrated by broken line in FIG. 4, and applies it to the charging member 146.

In FIG. 4, the waveform of the development bias voltage V1 is shifted from the waveform of the charge bias voltage V2 (V2'). However, the phases of voltages V2 (V2') and the voltage V1 are actually synchronized with each other. Further, in the phase (or waveform) on the positive side, the charge bias voltage V2 (V2') exhibits an offset potential difference Vd with respect to the development bias voltage V1. In the phase on the positive side, the charge bias voltage takes on a value of Vc.

It is assumed that the output of the DC power source DC1 is −400 V, the output voltage of the AC power source YAC1 exhibits a peak-to-peak voltage of 1800 V (duty 40%), and the control unit CT controls the output voltage of the DC power source DC2 to attain +400 V. In this case, the AC charge bias voltage is equal to V2, and the offset potential difference Vd is equal to 100 V (Vc=400 V).

By controlling the DC power source DC2 to provide an output of +400 V, a current flows through the diode d in the phase on the positive side of the development bias voltage V1, and the resistance r2 offsets the voltage. In this manner, the bias value Vc on the positive side of the AC charge bias voltage becomes equal to +400 V, and the offset potential difference Vd becomes equal to 100 V.

In the phase on the negative side of the development bias voltage V1, a current does not flow through the diode d, and only an extremely weak process current flows through the resistance r2 so that the development bias voltage V1 and the charge bias voltage V2 attain the substantially equal potentials.

When the DC power source DC2 is controlled to provide the output of +200 V, the voltage Vc on the positive side (i.e., in the phase on the positive side) of the AC charge bias voltage is equal to 200 V, and is negatively offset by 300 V (the offset potential difference of 300 V) with respect to the development bias voltage V1 (+500 V).

As described above, the offset potential difference Vd (in other words, the charge bias voltage value Vc on the positive side) can be controlled by controlling the output of the charge DC power source DC2 by the control unit CT.

Further, by increasing the charge bias on the positive side and decreasing the offset potential difference Vd, as is done in the AC charge bias voltage V2, the charge amount of the toner, which is charged by the charging member 146, on the developing roller 141 decreases corresponding to such decreasing of the difference. Also, by decreasing the charge bias on the positive side and increasing the offset potential difference Vd, as is done in the AC charge bias voltage V2', the charge amount of the toner, which is charged by the charging member 146, on the developing roller 141 increases corresponding to such increasing of the difference.

As will be described later, the control unit CT controls the offset potential difference (the toner charge amount) in the foregoing two stages. However, the control may be performed in three or more stages.

Although description has been given by way of example on the operation of the bias applying circuit in the yellow developing device, the bias applying circuits in the other developing devices operate in the same manner. In this image forming apparatus, all the developing devices are configured to achieve the same charge bias voltage value Vc on the positive side of the AC charge bias voltage V2 (or V2').

In each developing device of this image forming apparatus, the amplitude of the AC development bias voltage V1 applied to the developing roller 141 is set independently of the other developing devices, and more specifically is set according to characteristics and others of the toner used in the developing device so that the toner can move from the developing roller 141 onto the electrostatic latent image on the photosensitive member 11 as smoothly as possible, and in other words, good developing property can be achieved.

In the image forming apparatus thus configured, the AC charge bias voltage V2 (or V2') of each developing device exhibits the same (equal) charge bias value Vc in the phase on the positive side as those of the other developing devices. Therefore, in the developing device of which AC development bias voltage V1 is set to have a large amplitude, the same charge bias value Vc causes the large offset potential difference Vd with respect to the AC development bias voltage, and thereby absolute value of the charge amount of the developer charged by the charging member 146 increases.

Figure 5:
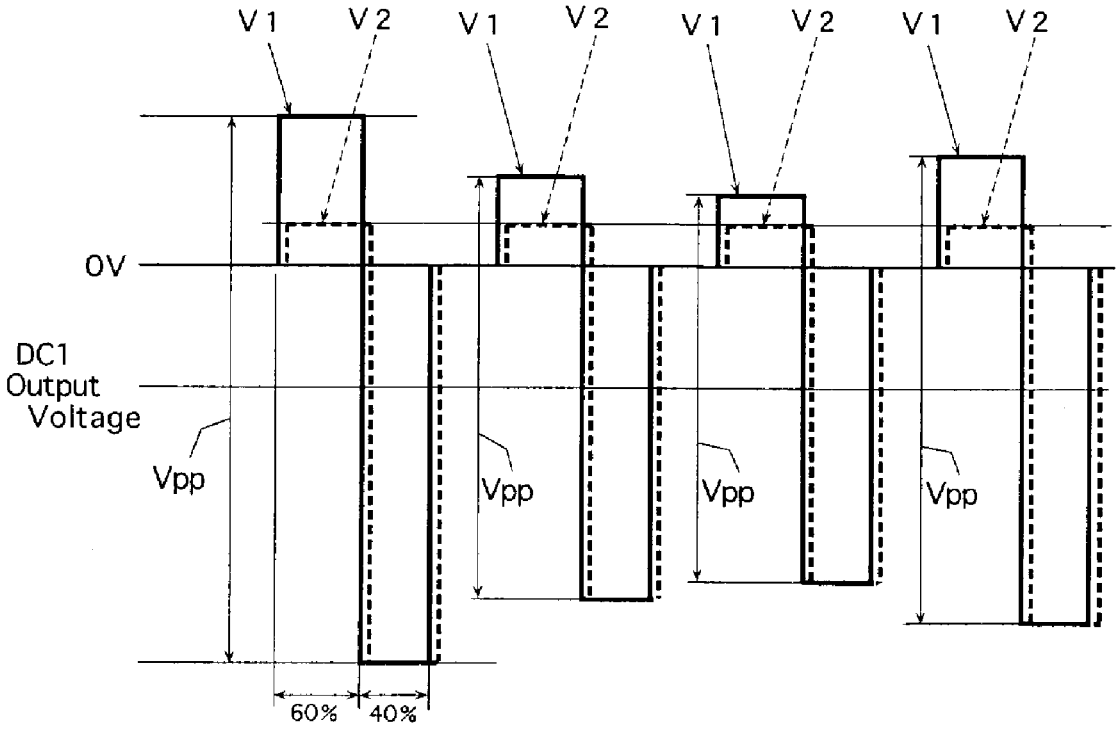
FIG. 5 illustrates a manner in which an offset potential difference changes according to an amplitude of the AC development bias voltage.

FIG. 5 represents that the offset potential difference varies according to the magnitude of the amplitude. However, the large amplitude of the AC development bias voltage V1 covers the lowering of the developing property.

Accordingly, each developing device can ensure the good developing property and the appropriate developer charge amount, and thereby can form an image of high quality.

Further, the charge bias applying device for each developing device applies the AC charge bias voltage V2 (or V2'), which has the phase synchronized with the AC development bias voltage V1, to the charging member 146. Therefore, the AC power source of the development bias applying device can be used also as the AC power source of the charge bias applying device so that each developing device can be inexpensive, and thus the image forming apparatus can be inexpensive.

In the developing device described above, the offset potential difference Vd is caused in the phase on the positive side to achieve the same charge bias voltage Vc. However, the phase on the negative side can be configured in the same manner. For this, the four diodes d in FIG. 3 are connected reversely and the output of the charge DC power source DC2 is changed, and thereby the phase on the negative side of the AC charge bias voltage is controlled in the same manner in each developing device. This control of the phase on the negative side is effective when using the positively chargeable toner.

Figure 6:
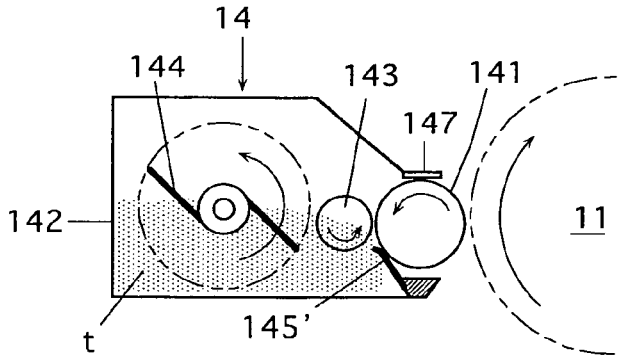
FIG. 6 shows another example of the developing device structure.

Each developing device 14 already described has the toner restricting member 145 and the charging member 146 independent of each other. As shown in FIG. 6, however, a toner restricting member 145' also serving as a charging member may be employed, and an AC charge bias voltage may be applied thereto.

The developing device 14 shown in FIG. 6 has substantially the same structure as the developing device 14 illustrated in FIG. 2 except for the employment of the toner restricting member 145' also serving as the charging member. The same parts and portions bear the same reference numbers as those in FIG. 2. In the developing device 14 in FIG. 6, the toner restricting member 145' prevents the leakage of the toner between the lower portion of the developing roller 141 and the casing 142.

The image forming apparatus according to the invention is not restricted to the image forming apparatus in FIG. 1 already described. The invention can be applied, e.g., to a color image forming apparatus in FIG. 8.

Figure 8:
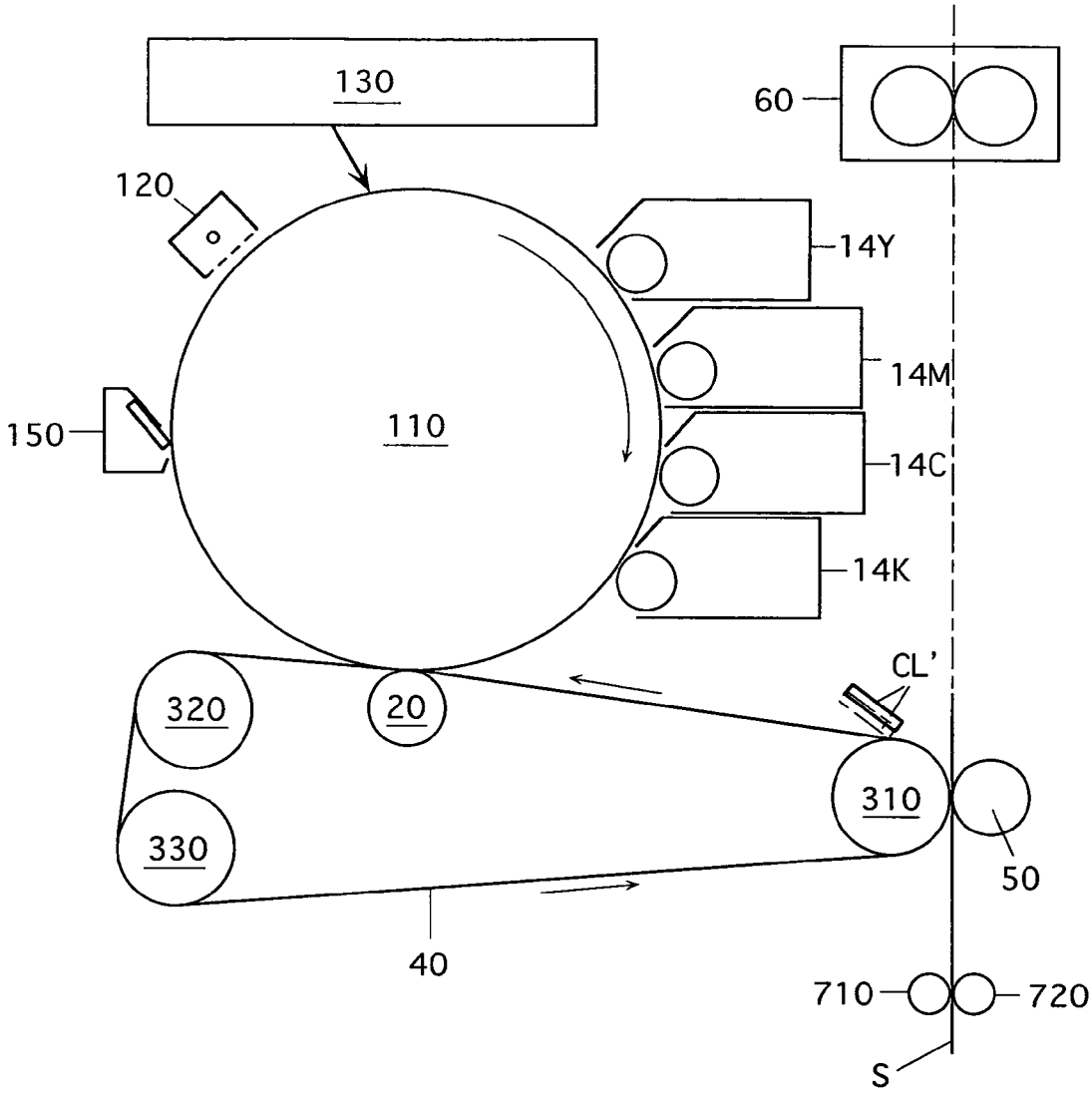
FIG. 8 schematically shows a structure of another example of an image forming apparatus according to the invention.
Figure 9:
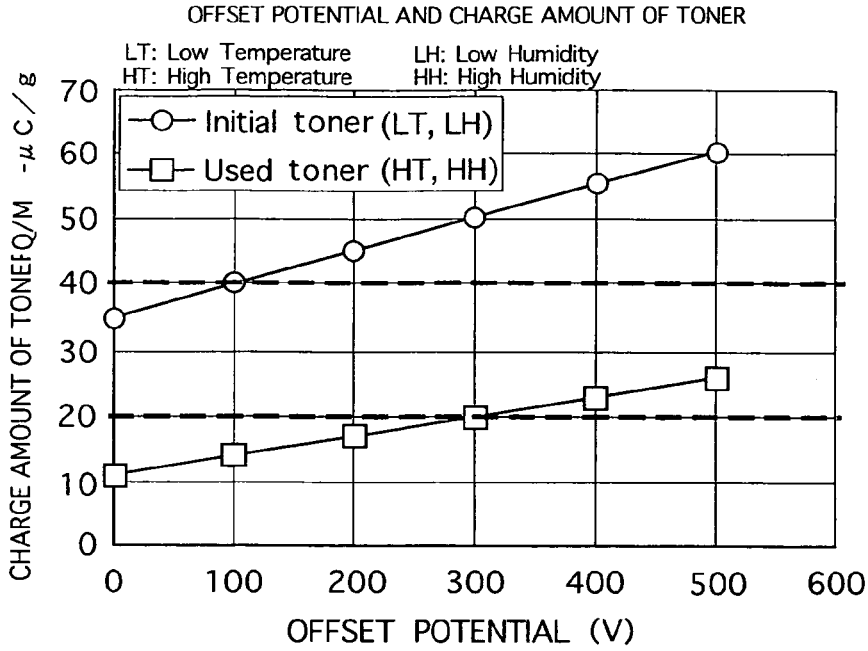
FIG. 9 shows a relationship between an offset potential difference and a toner charge amount.
Figure 10A:
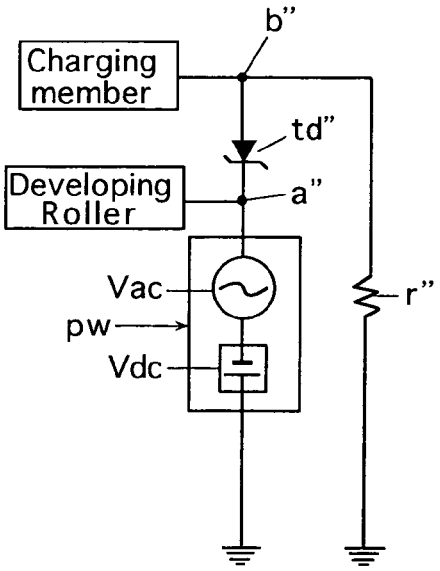
FIG. 10(A) shows an example of a conventional developing device circuit.
Figure 10B:
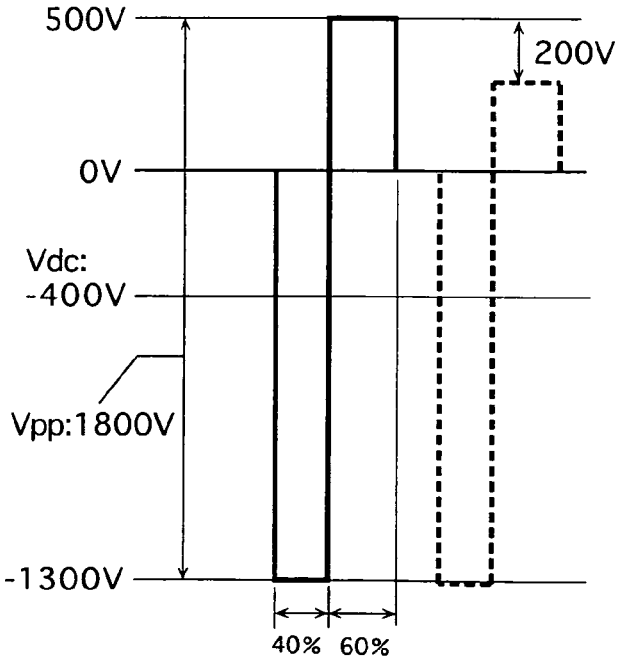
FIG. 10(B) shows a bias waveform of the conventional developing device circuit.

The image forming apparatus shown in FIG. 8 has a photosensitive member 110 of a drum type. A charging device 120, a yellow developing device 14Y, a magenta developing device 14M, a cyan developing device 14C and a black developing device 14K as well as a transfer roller 20 and a cleaner 150 are arranged in this order around the photosensitive member 110.

An image exposing device 130 is arranged above the photosensitive member 110, and an endless transfer belt 40 is arranged under the photosensitive member 110. The endless transfer belt 40 is wound around a drive roller 310 and driven rollers 320 and 330. The transfer roller 20 is opposed to the photosensitive member 110 with the transfer belt 40 therebetween.

A secondary transfer roller 50 is opposed to a portion of the transfer belt 40 around the drive roller 310, and a fixing device 60 is arranged above the secondary transfer roller 50.

This image forming apparatus can form an image by using at least one of the four developing devices. In the case where all the four developing devices are used for forming a full-color image, the photosensitive member 110 rotates clockwise in FIG. 8, and the charging device 120 uniformly charges the surface of the photosensitive member 110 to bear a predetermined potential. The image exposing device 130 effects image exposure for an yellow image on the charged region to form an electrostatic latent image for yellow on the photosensitive member 110. The developing roller bearing the development bias in the developing device 14Y having yellow toner develops this electrostatic latent image into a visible yellow toner image, which is transferred by the primary transfer roller 20 onto the transfer belt 40.

Likewise, the magenta, cyan and black developing devices 14M, 14C and 14K form the magenta, cyan and black toner images, respectively, and transfer them onto the transfer belt 40.

The magenta, cyan and black toner images are transferred onto the intermediate transfer belt 40 in a superimposed fashion, and thus the timing formation is performed.

The multiple toner images formed on the transfer belt 40 are moved by the rotating transfer belt 40 toward the secondary transfer roller 50.

The recording medium S is pulled out from a recording medium supply unit (not shown), and is supplied by a timing roller pair 710 and 720 to a position between the transfer belt 40 and the secondary transfer roller 50 in synchronization with the multiple toner images on the belt 40. Then, the secondary transfer roller 50 performs the secondary transfer of the multiple toner images onto the recording medium S. Thereafter, the recording medium S is supplied into the fixing device 60, in which the multiple toner images are fixed onto the recording medium S by the heat and pressure so that a color image is formed on the recording medium S. Thereafter, the recording medium S is discharged from the apparatus.

In each formation of the color toner image, the cleaner 150 cleans and removes primary-transfer residual toner and others remaining on the photosensitive member 110 after the primary transfer. After the secondary transfer, a cleaner CL', which is in contact with the transfer belt 40, cleans the secondary-transfer residual toner and others remaining on the transfer belt 40 after the secondary transfer.

The developing device for each color described above can employ the developing device structure shown in FIG. 2 or 6, and can employ the bias applying circuit shown in FIG. 3. Thereby, each developing device can ensure the good developing property and the appropriate charge amount of the developer, and thus can form images of high quality.

Figure 7:
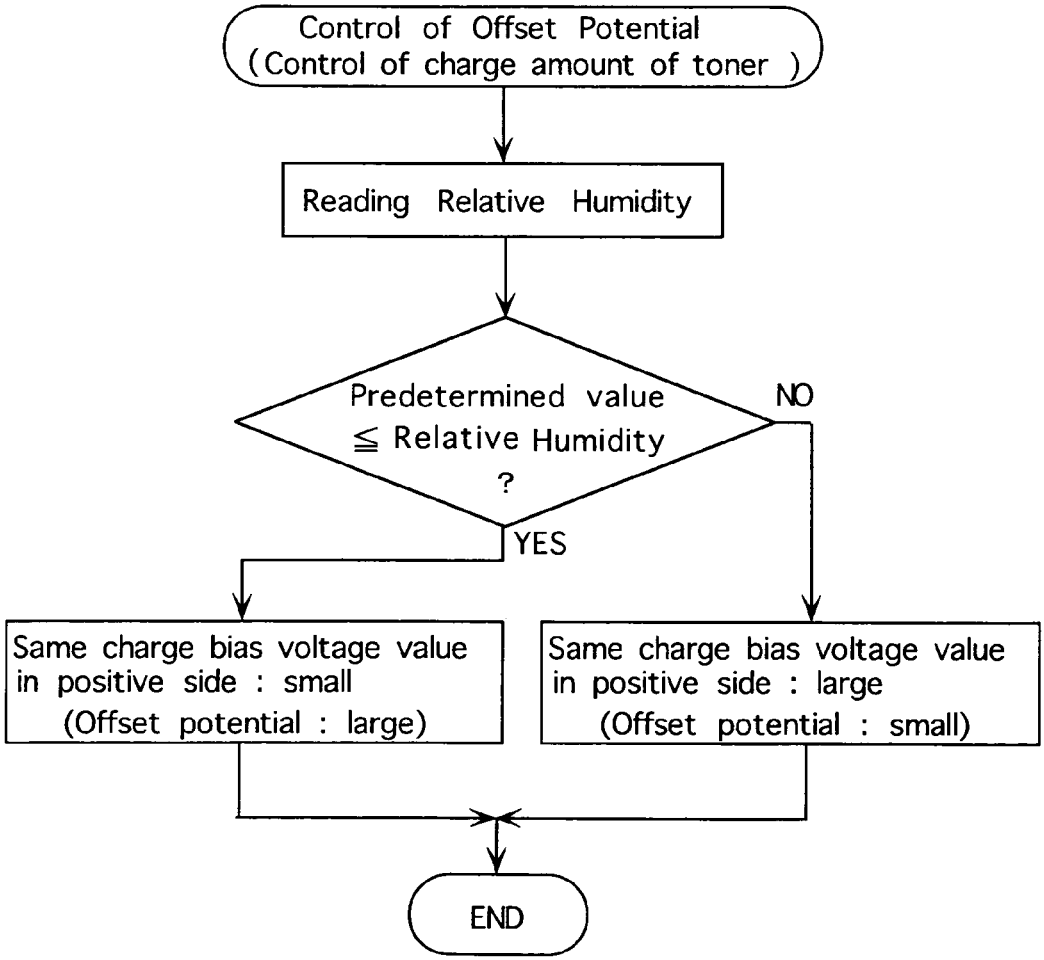
FIG. 7 is a flowchart illustrating an example of an offset potential difference control (toner charge amount control).

An example of control of the offset potential difference (toner charge amount) by the control unit CT shown in FIG. 3 will now be described with reference to FIG. 7.

A relative humidity is read from a temperature and humidity detecting unit (not shown) arranged in the image forming apparatus. When the relative humidity is lower than a predetermined value which is determined in advance by experiments or the like, a charge bias value (the same charge bias voltage value Vc in the phase on the positive side of the AC charge bias voltage) is set to a "large" value which is determined in advance by experiments or the like, and the offset potential difference Vd is set "small". When the relative humidity is equal to or higher than the predetermined value, the charge bias value Vc is set to a "small" value which is determined in advance by experiments or the like, and the offset potential difference Vd is set "large". Thereby, the charge amount of the toner charged by the charging member 146 (or 145') for use in development can have a regular charge amount.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising an image carrying member, a plurality of developing devices each capable of developing an electrostatic latent image formed on said image carrying member, a development bias applying device provided for each of said plurality of developing devices, a charge bias applying device provided for each of said plurality of developing devices and a control unit controlling said charge bias applying device provided for each of said plurality of developing devices, wherein each of said plurality of developing devices includes a developer carrying member carrying and transferring developer to a developing region developing said electrostatic latent image formed on said image carrying member, and a charging member being in contact with the developer carried on said developer carrying member and charging the developer;

said development bias applying device applies an AC development bias voltage including an AC voltage to said developer carrying member;

said charge bias applying device applies to said charging member an AC charge bias voltage having a phase synchronized with said AC development bias voltage and representing a charge bias voltage value causing an offset potential difference with respect to said AC development bias voltage in a phase on either one of positive and negative sides;

said charge bias voltage applied by the charge bias applying device provided for each of said plurality of developing devices and causing said offset potential difference has the same voltage value as the charge bias voltages applied by the charge bias applying devices of the other charge bias applying devices; and said control unit controls said charge bias applying device provided for each of said plurality of developing devices according to at least one of factors affecting a charging property of the developer transferred to said developing region, and thereby controls said same charge bias voltage value to provide said offset potential difference with respect to said AC development bias voltage in a phase on either one of positive and negative sides causing the developer to bear a regular charge amount for developing the electrostatic latent image.

2. The image forming apparatus according to claim 1, wherein each of said AC development bias voltage and said AC charge bias voltage is a rectangular-wave AC voltage.

3. The image forming apparatus according to claim 1, wherein said development bias applying device provided for each of said developing devices includes a development bias power source applying said AC development bias voltage to said developer carrying member, said charge bias applying device provided for each of said developing devices includes a resistance element, a diode and an output-variable charge DC power source, and said resistance element, said diode and said output-variable charge DC power source are connected in series to an output terminal of said development bias power source in this order, and said output-variable charge DC power source is a DC power source common to the charge bias applying devices provided for said plurality of developing devices.

4. The image forming apparatus according to claim 3, wherein said control unit controls an output voltage of said common DC power source, and thereby controls the same charge bias voltage value.

5. The image forming apparatus according to claim 1, wherein a detector for detecting an environmental condition is further provided, and said control unit controls said charge bias applying device provided for each of said plurality of developing devices according to the environmental condition detected by said detector, and thereby controls the same charge bias voltage value.

6. The image forming apparatus according to claim 5, wherein said environmental condition is an ambient humidity.

7. A developing method in an image forming apparatus including a plurality of developing devices comprising:

transferring developer by a developer carrying member to a developing region developing an electrostatic latent image formed on an image carrying member;

applying an AC development bias voltage to said developer carrying member;

applying an AC charge bias voltage to a charging member being in contact with the developer carried on said developer carrying member, said AC charge bias voltage having a phase synchronized with said AC development bias voltage and representing a charge bias voltage value causing an offset potential difference with respect to said AC development bias voltage in a phase on either one of positive and negative sides and common to said developing devices;

controlling said common charge bias voltage value according to at least one of factors affecting a charging property of the developer to provide said offset potential difference with respect to said AC development bias voltage in a phase on either one of positive and negative sides to cause the developer to bear a regular charge amount for developing an electrostatic latent image; and developing the electrostatic latent image on said image carrying member by the developer at said developing region.

8. The developing method in an image forming apparatus including a plurality of developing devices according to claim 7, wherein each of said AC development bias voltage and said AC charge bias voltage is a rectangular-wave AC voltage.

9. The developing method in an image forming apparatus including a plurality of developing devices according to claim 7, further comprising:

detecting an environmental condition; and controlling said common charge bias voltage value causing said offset potential difference according to the detected environmental condition.

10. The developing method in an image forming apparatus including a plurality of developing devices according to claim 9, wherein said environmental condition is an ambient humidity.

11. The developing method in an image forming apparatus including a plurality of developing devices according to claim 7, wherein said AC charge bias voltage is applied to said charging member by a charge bias applying device provided for each of said plurality of developing devices , which includes an output-variable charge DC power source common to the charge bias applying devices; and the charge bias voltage value is controlled by controlling an output of said output-variable charge DC power source.

* * * * *